US008065778B2

(12) United States Patent
Kim et al.

(10) Patent No.: US 8,065,778 B2
(45) Date of Patent: Nov. 29, 2011

(54) ROBOT CLEANER

(75) Inventors: Dong Won Kim, Suwon-si (KR); Jae Man Joo, Suwon-si (KR); Jun Pyo Hong, Suwon-si (KR); Chang Woo Kim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 548 days.

(21) Appl. No.: 12/222,301

(22) Filed: Aug. 6, 2008

(65) Prior Publication Data

US 2009/0100630 A1 Apr. 23, 2009

(30) Foreign Application Priority Data

Oct. 17, 2007 (KR) ..... 10-2007-0104300

(51) Int. Cl.

| | |
|---|---|
| ***A47L 5/00*** | (2006.01) |
| ***A47L 9/10*** | (2006.01) |
| ***A47L 9/20*** | (2006.01) |

(52) U.S. Cl. ..... 15/319; 15/349

(58) Field of Classification Search ..... 15/319, 15/349, 41.1–48.2, 340.1–340.4
See application file for complete search history.

(56) References Cited

U.S. PATENT DOCUMENTS

| | | | | |
|---|---|---|---|---|
| 1,143,959 | A * | 6/1915 | Harris | 15/341 |
| 2005/0015920 | A1* | 1/2005 | Kim et al. | 15/352 |
| 2005/0115409 | A1* | 6/2005 | Conrad | 95/271 |
| 2007/0157413 | A1* | 7/2007 | Roumagnac | 15/302 |

FOREIGN PATENT DOCUMENTS

| | | |
|---|---|---|
| KR | 20-0335861 | 12/2003 |

* cited by examiner

*Primary Examiner* — Bryan R Muller
(74) *Attorney, Agent, or Firm* — Staas & Halsey LLP

(57) ABSTRACT

A robot cleaner that is capable of preventing dust collected in a dust tank from flowing backward outside when a situation in which the dust may be discharged outside occurs includes a cleaner body, a dust tank mounted in the cleaner body to collect dust, and a backward-flow preventing device to prevent dust from flowing backward outside through a suction port of the dust tank. The backward-flow preventing device includes a shutter unit to open and close the suction port and a stopper unit to drive the shutter unit.

8 Claims, 7 Drawing Sheets

ROBOT CLEANER

CROSS-REFERENCE TO RELATED APPLICATIONS

This application claims the benefit of Korean Patent Application No. 2007-104300, filed on Oct. 17, 2007 in the Korean Intellectual Property Office, the disclosure of which is incorporated herein by reference.

BACKGROUND

1. Field

The present invention relates to a robot cleaner, and, more particularly, to a robot cleaner that is capable of preventing dust in a dust tank from being discharged outside.

2. Description of the Related Art

A cleaner is an appliance that removes foreign matter to make rooms clean. A vacuum cleaner that suctions foreign matter using a suction force of a low-pressure part is generally used.

In recent years, a robot cleaner has been developed which moves itself using an automatic running function without the labor of a user to remove foreign matter from the floor of a room.

An example of a robot cleaner includes a cleaner case having a suction port to suction dust or dirt and an exhaust port to discharge air, a fan motor mounted inside the cleaner case to generate a suction force, a dust tank mounted in front of the fan motor to collect dust or dirt suctioned by the fan motor, a suction head mounted at the bottom of the cleaner case, such that the suction head communicates with the dust tank through a connection channel, to suction dust or foreign matter from the floor, and a brush rotatably mounted in the suction head to sweep dust or foreign matter on the floor.

However, the conventional robot cleaner has a problem in that, when a user lifts or inclines the cleaner case, dust collected in the dust tank may be discharged outside.

An example of a cleaner to solve the problem is disclosed in Korean Utility Model Registration No. 20-335861.

The disclosed cleaner includes a backward-flow preventing plate hingedly coupled to the sidewall of a guide part such that the backward-flow preventing plate can maintain its horizontal state and freely rotate according to the inclination angle of a housing while the backward-flow preventing plate is in tight contact with the bottom of the guide part, in a backward-flow prevention structure of a dust collector having a predetermined receiving space to store waste introduced through an inlet port by the provision of a step protrusion formed at the end of a guide part extending by a predetermined length from the inlet port.

Consequently, the waste and dust stored in the dust collector are prevented from being discharged out of the dust collector contrary to a user's intention, and therefore, it is possible to freely shift or move the cleaner.

In the backward-flow prevention structure of the disclosed cleaner, however, it is not possible to open and close the backward-flow preventing plate when foreign matter, such as dust, exists in a channel in which the backward-flow preventing plate is opened and closed. Furthermore, when a user lifts and moves the cleaner approximately horizontally, the backward-flow preventing plate remains open, with the result that dust may be discharged outside.

SUMMARY

Therefore, it is an aspect of the invention to provide a robot cleaner that is capable of preventing dust collected in a dust tank from being discharged outside when a situation in which the dust may be discharged outside occurs.

It is another aspect of the invention to provide a robot cleaner that is capable of preventing dust collected in the dust tank from being discharged outside when the dust tank is separated from a cleaner body.

It is a further aspect of the invention to provide a robot cleaner that is capable of preventing dust collected in the dust tank from being discharged outside even when a user moves while holding the cleaner body in which the dust tank is mounted.

In accordance with one aspect, a robot cleaner includes a cleaner body, a dust tank mounted in the cleaner body to collect dust, and a backward-flow preventing device to prevent dust from flowing backward outside through a suction port of the dust tank, wherein the backward-flow preventing device includes a shutter unit to open and close the suction port and a stopper unit to drive the shutter unit.

Generally, the shutter unit includes an opening and closing plate hingedly mounted at the suction port side, a lever to hingedly rotate the opening and closing plate, and an elastic member to provide an elastic force necessary to maintain the closed state of the suction port achieved by the opening and closing plate.

In general, the stopper unit pushes the lever, such that the lever is hingedly rotated, to open the opening and closing plate and releases the pushed state of the lever to close the opening and closing plate.

Generally, the dust tank is separably coupled to the cleaner body, and the shutter unit opens and closes the suction port along with the coupling and the separation of the dust tank.

In general, the backward-flow preventing device further includes a stopper support part to allow or restrict the hinged rotation of the stopper unit.

Generally, the cleaner body includes an auxiliary wheel unit, the stopper support part is constructed to move vertically according to a load applied to the auxiliary wheel unit, and the shutter unit opens and closes the suction port along with the vertical movement of the stopper support part.

In general, the auxiliary wheel unit includes an auxiliary wheel, a guide rod to guide the vertical movement of the auxiliary wheel, and a spring fitted on the guide rod to elastically support the auxiliary wheel, and the stopper support part is provided at the guide rod.

In accordance with another aspect, a robot cleaner includes a cleaner body, a dust tank separably mounted in the cleaner body to collect dust, and a backward-flow preventing device to prevent dust from flowing backward outside through a suction port of the dust tank, wherein the backward-flow preventing device includes a shutter unit mounted at the suction port in an openable and closable fashion and a stopper unit to hingedly rotate the shutter unit along with the coupling and separation of the dust tank.

Generally, the backward-flow preventing device further includes a stopper support part to support a predetermined position of the stopper unit such that the stopper unit hingedly rotates the shutter unit.

In accordance with a further aspect, a robot cleaner includes a cleaner body, a dust tank mounted in the cleaner body to collect dust, and a backward-flow preventing device to prevent dust from flowing backward outside through a suction port of the dust tank, wherein the backward-flow preventing device includes a shutter unit mounted at the suction port in an openable and closable fashion and a stopper unit to hingedly rotate the shutter unit along with the vertical movement of the cleaner body.

In general, the backward-flow preventing device further includes a stopper support part to support a predetermined position of the stopper unit or release the supported state of the stopper unit such that the stopper unit hingedly rotates the shutter unit along with the vertical movement of the cleaner body.

Generally, the cleaner body includes an auxiliary wheel constructed to move vertically according to a load applied to the auxiliary wheel, and the stopper support part moves vertically along with the vertical movement of the auxiliary wheel.

Additional aspects and/or advantages of the invention will be set forth in part in the description which follows and, in part, will be apparent from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings, of which.

DETAILED DESCRIPTION OF EMBODIMENTS

Figure 1:
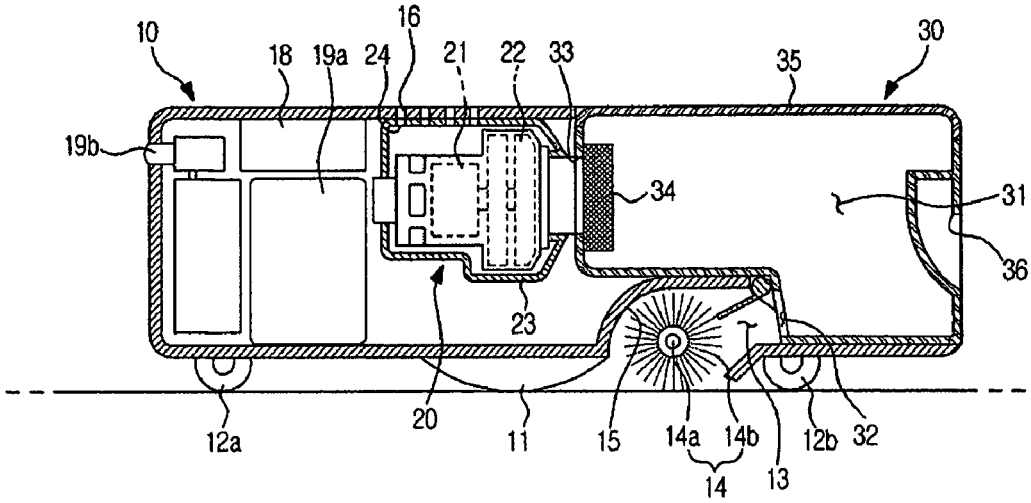
FIG. 1 is a sectional view illustrating the overall structure of a robot cleaner according to an embodiment of the present invention.

Reference will now be made in detail to the embodiment of the present invention, examples of which are illustrated in the accompanying drawings, wherein like reference numerals refer to like elements throughout. The embodiments are described below to explain the present invention by referring to the figures.

Figure 2:
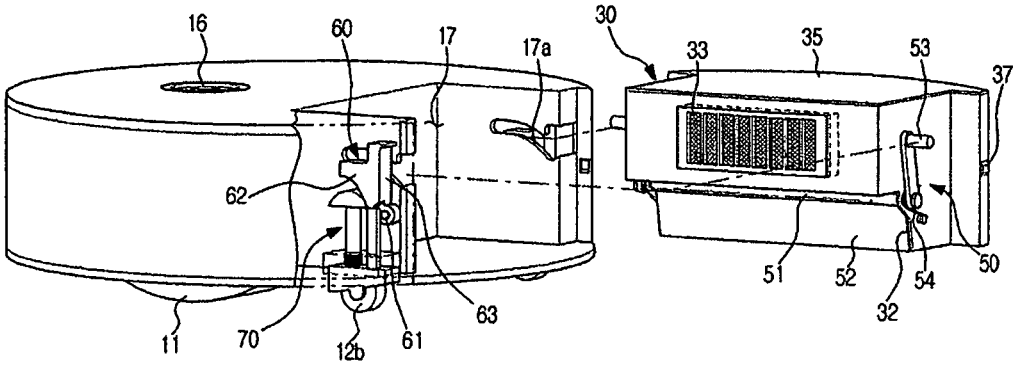
FIG. 2 is an exploded perspective view illustrating a cleaner body and a dust tank of the robot cleaner according to an embodiment of the present invention.
Figure 3:
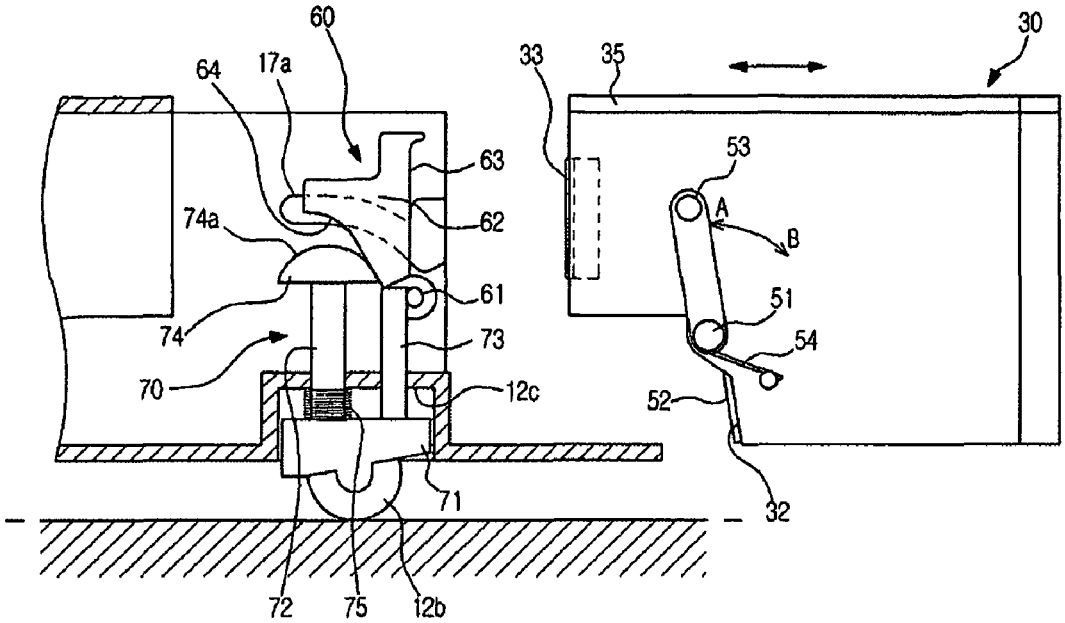
FIG. 3 is a side view illustrating the principal components of the robot cleaner according to an embodiment of the present invention.

FIG. 1 is a sectional view illustrating the overall structure of a robot cleaner according to an embodiment of the present invention, FIG. 2 is an exploded perspective view illustrating a cleaner body and a dust tank of the robot cleaner according to an embodiment of the present invention, and FIG. 3 is a side view illustrating the principal components of the robot cleaner according to an embodiment of the present invention.

As shown in FIGS. 1 and 2, the robot cleaner includes a cleaner body 10 forming the external appearance of the robot cleaner, a blowing unit 20 mounted in the cleaner body 10 to generate a suction force necessary to suction dust, a dust tank 30 communicating with the blowing unit 20 to collect duct introduced into the cleaner body 10, and a rotary brush unit 14 to sweep or scatter dust on the floor such that the dust is introduced into the dust tank 30.

At opposite sides of the middle of the bottom of the cleaner body 10, forming the external appearance of the robot cleaner, are mounted a pair of drive wheels 11 such that the drive wheels 11 are spaced a predetermined distance from each other, respectively, as shown in FIG. 1. The drive wheels 11 are driven by a motor (not shown). In the front and the rear of the drive wheels 11 is mounted an auxiliary wheel unit 12*a* and 12*b* to support the cleaner body 10 and assist the smooth movement of the robot cleaner, respectively. The drive wheels 11 are selectively driven by the motor, which separately rotates the drive wheels 11. Consequently, the rectilinear movement and the rotary movement of the cleaner body 10 are possible, and therefore, the robot cleaner can move in desired directions.

In the rear of the drive wheels 11 is formed an elongated opening 13 to introduce dust from the floor into the dust tank 30. Of course, the opening 13 may be formed at various positions where dust can be easily suctioned, for example, between the drive wheels or in front of the drive wheels.

The auxiliary wheel unit 12*a* and 12*b* includes a front auxiliary wheel 12*a* mounted at the front side of the cleaner body 10 and a pair of rear auxiliary wheels 12*b* mounted at the rear side of the cleaner body 10.

The rotary brush unit 14 is mounted at the bottom of the cleaner body 10 to sweep or scatter dust or dirt on the floor, thereby improving dust suction efficiency.

The rotary brush unit 14, formed in the shape of a lengthy cylinder, is rotatably mounted at the cleaner body 10 such that the rotary brush unit 14 is partially exposed from the bottom of the cleaner body 10. For the installation of the rotary brush unit 14, an arc-shaped location part 15, depressed to a predetermined depth, is formed at the cleaner body 10.

The rotary brush unit 14 includes a brush rod 14*a*, having a length corresponding to the opening 12, disposed adjacent to the opening 12 in the horizontal direction, a brush drive part (not shown) to drive the brush rod 14*a*, and brush hair 14*b* formed at the outer circumference of the brush rod 14*a*.

Consequently, when the brush rod 14*a* is rotated by the brush drive part (not shown), and therefore, dust is swept or scattered by the brush hair 14*b*, the swept dust is introduced into the dust tank 30 through the opening 13 by a rotary force of the rotary brush unit 14, and the scattered dust is easily introduced into the dust tank 30 through the opening 13 by the driving of the blowing unit 20.

At the top of the cleaner body 10 is formed a discharge port 16 to discharge dust suctioned by the blowing unit 20 out of the cleaner body 10.

Also, a dust tank installation part 17 is formed at the rear side of the cleaner body 10 to allow the dust tank 30 to be installed therein.

Also, a controller 18 to control the operation of the robot cleaner and a rechargeable battery 19*a* to supply power necessary for the operation of the robot cleaner are mounted. At the side of the cleaner body 10 is mounted an obstacle sensor 19*b*, such as an infrared sensor or an ultrasonic sensor, to allow the robot cleaner to detour around obstacles.

The obstacle sensor 19*b* measures the distance to the wall or the furniture located around the robot cleaner, and transmits the measured information to the controller 18, which controls the driving of the drive wheels 11 based on the transmitted information.

The blowing unit 20, which generates a suction force to the dust tank 30, includes a motor 21 and a blowing fan 22 constructed to be driven by the motor 21. The motor 21 and the blowing fan 22 are fixedly mounted in a single case 23.

The blowing fan 22 of the blowing unit 20, which is applied to the present invention, is a centrifugal fan that suctions air in the axial direction and discharges the air in the radial direction. The air, discharged by the blowing fan 22, cools the motor 21, flows through a plurality of through-holes 24 formed at the case 23 in the radial direction, and is finally discharged out of the cleaner body 10 through the discharge port 16, which is formed at the top of the cleaner body 10.

The dust tank 30, which collects dust introduced into the cleaner body 10 by the suction force generated by the driving of the blowing unit 20, is disposed adjacent to the blowing unit 20.

The dust tank 30 is formed approximately in the shape of a rectangular box having a size corresponding to the dust tank installation part 17 of the cleaner body 10. In the dust tank 30 is defined a collection part 31 to receive dust or dirt from the floor by virtue of the suction force generated through the driving of the blowing unit 20 and/or the rotary brush unit 14.

At the lower front of the dust tank 30 is formed a suction port 32 communicating with the opening 13 of the cleaner body 10 to suction dust into the dust tank 30. At the upper front of the dust tank 30 is formed a discharge port 33 to discharge the suctioned air to the blowing unit 20. At the discharge port 33 is mounted a filter 34 to purify the air introduced into the dust tank 30. Also, the dust tank 30 has a cover 35 to open and close the top of the collection part 31. Consequently, it is possible for a user to separate the dust tank 30 from the cleaner body 10 and detach the cover 35, thereby easily removing the dust collected in the dust tank 30.

At the rear side of the dust tank 30 is formed a grip part 36 to allow the user to easily install and uninstall the dust tank 30 into and from the cleaner body 10. At opposite lateral sides of the dust tank 30 are formed protrusions 37 by which the dust tank 30 is securely fixed to the cleaner body 10. At the dust tank installation part 17 are formed grooves (not shown) corresponding to the protrusions 37.

Also, a dust amount sensor (not shown) to sense the amount of dust collected in the dust tank 30 may be mounted in the dust tank 30. An alarm device (not shown) may be also provided to inform a user of the amount of dust in the dust tank when a predetermined amount of dust is collected in the dust tank 30.

The robot cleaner according to an embodiment of the present invention further includes a backward-flow preventing device comprising a shutter unit 50, stopper units 60, and stopper support parts 74 to prevent dust or waste in the collection part 31 of the dust tank 30 from flowing backward outside through the suction port 32 of the dust tank 30.

The backward-flow preventing device 50, 60, and 74 includes a shutter unit 50 mounted at the dust tank 30 to open and close the suction port 32 of the dust tank 30, stopper units 60 to drive the shutter unit 50, and stopper support parts 74 to support the stopper units 60 or release the supported state of the stopper units 60.

As shown in FIGS. 2 and 3, the shutter unit 50 includes an opening and closing plate 52 hingedly mounted at the suction port 32 side, the opening and closing plate 52 having a hinge shaft 51 formed at the upper end thereof, levers 53 extending from the hinge shaft 51 such that an external force necessary to hingedly rotate the opening and closing plate 52 is easily applied to the levers 53, and elastic members 54 to provide an elastic force necessary to maintain the closed state of the suction port 32 achieved by the opening and closing plate 52 when the external force is not applied to the levers 53.

The opening and closing plate 52 is formed approximately in the shape of a rectangle corresponding to the suction port 32. The hinge shaft 51 is formed at the upper end of the opening and closing plate 52, and therefore, the opening and closing plate 52 is hingedly connected to the upper end of the suction port 32.

The levers 53 are coupled to the hinge shaft 51 such that the levers 53 protrude through the opposite lateral sides of the dust tank 30. The opening and closing plate 52 is hingedly rotated to open or close the suction port 32 according to the hinged rotation of the levers 53 in the direction indicated by an arrow B or an arrow A At the dust tank installation part 17 of the cleaner body 10 are formed guides **17*a* to guide the movement of the levers 53**.

According to circumstances, a single lever 53 may be mounted at any one of the lateral sides of the dust tank 30, and a single guide corresponding to the single lever 53 may be formed at the dust tank installation part 17. Even in this case, it is possible to hingedly rotate the opening and closing plate in the same manner as in the embodiment of the present invention.

Consequently, the guide **17*a* provides the hinged rotation space for the levers 53, even in a state in which the dust tank 30 is coupled into the dust tank installation part 17, and therefore, the suction port 32 is opened or closed by the opening and closing plate through the hinged rotation of the levers 53**.

The elastic members 54 are coupled to the hinge shaft 51 to provide an elastic force necessary for the opening and closing plate 52 to keep the suction port 32 closed when no external force is applied to the levers 53.

The middle of each elastic member 54 is fitted on the hinge shaft 51. One end of each elastic member 54 is fixed to the outside of the dust tank 30, and the other end of each elastic member 54 is fixed to the corresponding lever 53.

Consequently, when an external force is applied to the levers 53 to hingedly rotate the levers 53, the opening and closing plate 52 opens the suction port 32 while the elastic members 54 are deformed. When the external force is released, the levers 53 return to their original positions by the restoring force of the elastic members 54. At this time, the opening and closing plate 52 is hingedly rotated along with the movement of the levers 53 to close the suction port 32.

A pair of stopper units 60 are mounted at opposite lateral sides of the dust tank installation part 17 of the cleaner body 10 such that the stopper units 60 correspond to the levers 53.

Each stopper unit 60 includes a hinge shaft 61 formed at the corresponding lateral side of the dust tank installation part 17 and a stopper member 62 hingedly coupled to the hinge shaft 61.

At the rear side of the stopper member 62 is formed a rectilinear lever contact part 63 with which the corresponding lever 53 comes into contact upon the insertion of the dust tank 30. The upper end of the lever contact part 63 is curved to prevent the separation of the corresponding lever 53.

At the side opposite to the lever, contact part 63 is formed on the stopper member 62 at a location opposite to part 64, which is located immediately above the corresponding stopper support part 74, which will be described in the following.

When the stopper support part 74 comes into the contact with the location part 64, the hinged rotation of the stopper unit 60 is restricted, and, upon the insertion of the dust tank 30, the lever 53 is pushed by the lever contact part 63 of the stopper member 62, with the result that the lever 53 is hingedly rotated, and therefore, the opening and closing plate 52 opens the suction port 32.

Consequently, the suction port 32 of the dust tank 30, separated from the cleaner body 10, is maintained in a closed state, and, when the dust tank 30 is coupled to the cleaner body 10, the opening and closing plate 52 is hingedly rotated to open the suction port 32. That is, the suction port 32 is opened and closed along with the coupling and separation of the dust tank 30 to and from the cleaner body 10.

When the stopper support part 74 moves downward, and therefore, the stopper support part 74 is separated from the corresponding location part 64, the lever 53 is hingedly rotated along the guide 17*a* by the restoring force of the elastic member 54, since the stopper member 62 is hingedly rotated toward the stopper support part 74. Simultaneously with the hinged rotation of the lever 53, the opening and closing plate 52 closes the suction port 32. That is, when the stopper support part 74 moves downward, the suction port 32 of the dust tank 30 is closed even in a state in which the dust tank 30 is mounted in the dust tank installation part 17.

As an example of the stopper support part 74 moving downward, the stopper support part 74 may be constructed to move downward when a user lifts the cleaner body 10.

The structure in which the stopper support part 74 moves downward when the cleaner body 10 is lifted may be realized through various mechanical devices. In the embodiment of the present invention, the stopper support part 74 is constructed to move vertically along with the vertical movement of the corresponding rear auxiliary wheel 12*b*.

Figure 4:
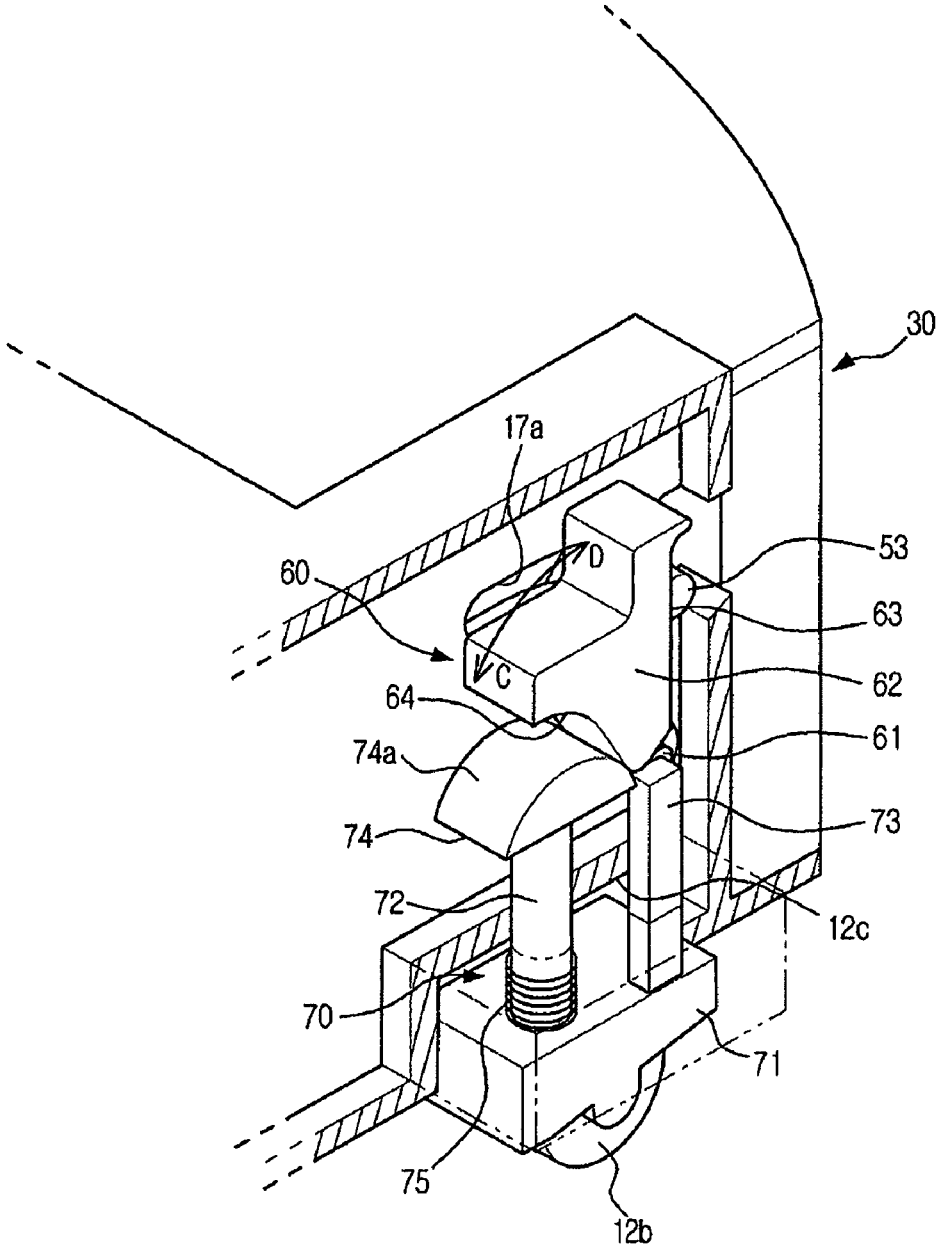
FIGS. 4 and 5 are perspective views, in part, illustrating the operation of a backward-flow preventing device in a state in which the dust tank is coupled to the cleaner body of the robot cleaner according to an embodiment of the present invention.

As shown in FIG. 4, each rear auxiliary wheel unit 70 includes a rear auxiliary wheel 12*b*, a wheel fixing part 71 to rotatably fix the rear auxiliary wheel 12*b*, first and second guide rods 72 and 73 mounted at the top of the wheel fixing part 71 to guide the vertical movement of the auxiliary wheel 12*b*, a spring 75 fitted on the first guide rod 72 to generate an elastic force between the bottom of the cleaner body 10 and the top of the wheel fixing part 71, and a stopper support part 74 formed at the top of the first guide rod 72.

The wheel fixing part 71 is formed approximately in the shape of a cylinder. In the wheel fixing part 71 is rotatably mounted the auxiliary wheel 12*b*. The wheel fixing part 71 is located in a corresponding wheel installation part 12*c* formed at the bottom of the cleaner body 10.

The guide rods 72 and 73 are formed at the top of the wheel fixing part 71. Although a single guide rod may be used to guide the vertical movement of the auxiliary wheel, a pair of guide rods 72 and 73 are generally used to stably guide the vertical movement of the rear auxiliary wheel 12*b*.

The stopper support part 74 is formed at the top of the first guide rod 72 to move vertically along with the vertical movement of the auxiliary wheel 12*b*.

At the top of the stopper support part 74 is formed a curved part 74*a* corresponding to the curved shape of the location part 64 of the stopper member 62 to assist the smooth hinged rotation of the stopper member 62.

The spring 75 is fitted on the first guide rod 72 between the bottom of the wheel installation part 12*c* and the top of the wheel fixing part 71 such that the spring is elastically deformed according to the load of the cleaner body 10 applied to the auxiliary wheel 12*b*. When the cleaner body 10 of the robot cleaner is placed on the even floor while no external force is applied to the cleaner body 10, the spring 75 is contracted by the weight of the cleaner body 10.

At this time, the rear auxiliary wheel 12*b* remains inserted in the wheel installation part 12*c*, and the stopper support part 74 supports the stopper member 62 upward, whereby the stopper member 62 pushes the corresponding lever 53, and therefore, the suction port 32 of the dust tank 30 is opened.

When a user lifts the cleaner body 10 or the cleaner body 10 is lifted by an external force, the spring 75 is extended by the restoring force thereof.

At this time, the rear auxiliary wheel 12*b* moves downward, with the result that the stopper support part 74, which is integrally coupled to the rear auxiliary wheel 12*b*, also moves downward.

With the vertical movement of the stopper support part 74, the supported state of the stopper member 62 is released, and therefore, the stopper member 62 hingedly rotates toward the stopper support part 74.

As a result, the corresponding lever 53, which has been pushed by the stopper member 62, is hingedly rotated by the restoring force to a position where the opening and closing plate 52 closes the suction port 32.

When a user lifts the cleaner body 10 or the cleaner body 10 is lifted by an external force in a state in which the dust tank 30 is coupled to the cleaner body 10, the spring 75 of the rear auxiliary wheel unit 70 extends, and the stopper support part 74, which supports the corresponding stopper unit 60, moves downward, whereby the stopper unit 60 hingedly rotates toward the stopper support part 74 by its own weight.

Consequently, the pushed state of the lever 53, which remains pushed by the stopper member 62, is released, and the opening and closing plate 52 is returned to its initial position to close the suction port 32 by the restoring force of the corresponding elastic force 54 of the shutter unit 50.

The robot cleaner according to the embodiment of the present invention is capable of opening the suction port 32, during the progress of the cleaning operation to introduce dust into the collection part 31. When the dust tank 30 is separated, a user lifts the cleaner body, or the cleaner body is lifted by an external cause, such as a sudden rise, the suction port 32 of the dust tank 30 is closed, and therefore, it is possible to prevent the dust collected in the dust tank 30 from flowing backward outside.

Although not shown in the drawings, the above-described structure may be applied identically to a robot cleaner constructed in a structure in which the dust tank is not separated from the cleaner body.

The robot cleaner having the dust tank is fixedly mounted in the cleaner body may be also constructed such that, when a user lifts the cleaner, or the cleaner body is lifted by an external cause, such as a sudden rise, the suction port of the dust tank is closed, and therefore, it is possible to prevent the dust collected in the dust tank from flowing backward outside.

Hereinafter, the operation of the robot cleaner according to the present invention will be described.

FIGS. 4 to 7 are views illustrating the operation of the robot cleaner according to an embodiment of the present invention.

First, the opening and closing plate 52 keeps the suction port 32 closed by the elastic force of the elastic member 54 in a state in which the dust tank 30 is separated.

When the dust tank 30 is coupled to the cleaner body 10, while the cleaner body 10 of the robot cleaner is placed on the floor, i.e., the spring 75 of the rear auxiliary wheel unit 70 is contracted by the load of the cleaner body 10, the lever 53 is pushed by the lever contact part 63 of the stopper member 62, and therefore, the lever 53 is hingedly rotated in the direction indicated by the arrow B to open the suction port 52.

On the other hand, when the dust tank 30 is separated from the cleaner body 10, the opening and closing plate is hingedly rotated by the elastic force of the elastic member 54 to close the suction port 32.

Consequently, dust in the dust tank 30 is prevented from flowing backward outside upon the separation of the dust tank 30.

Figure 6:
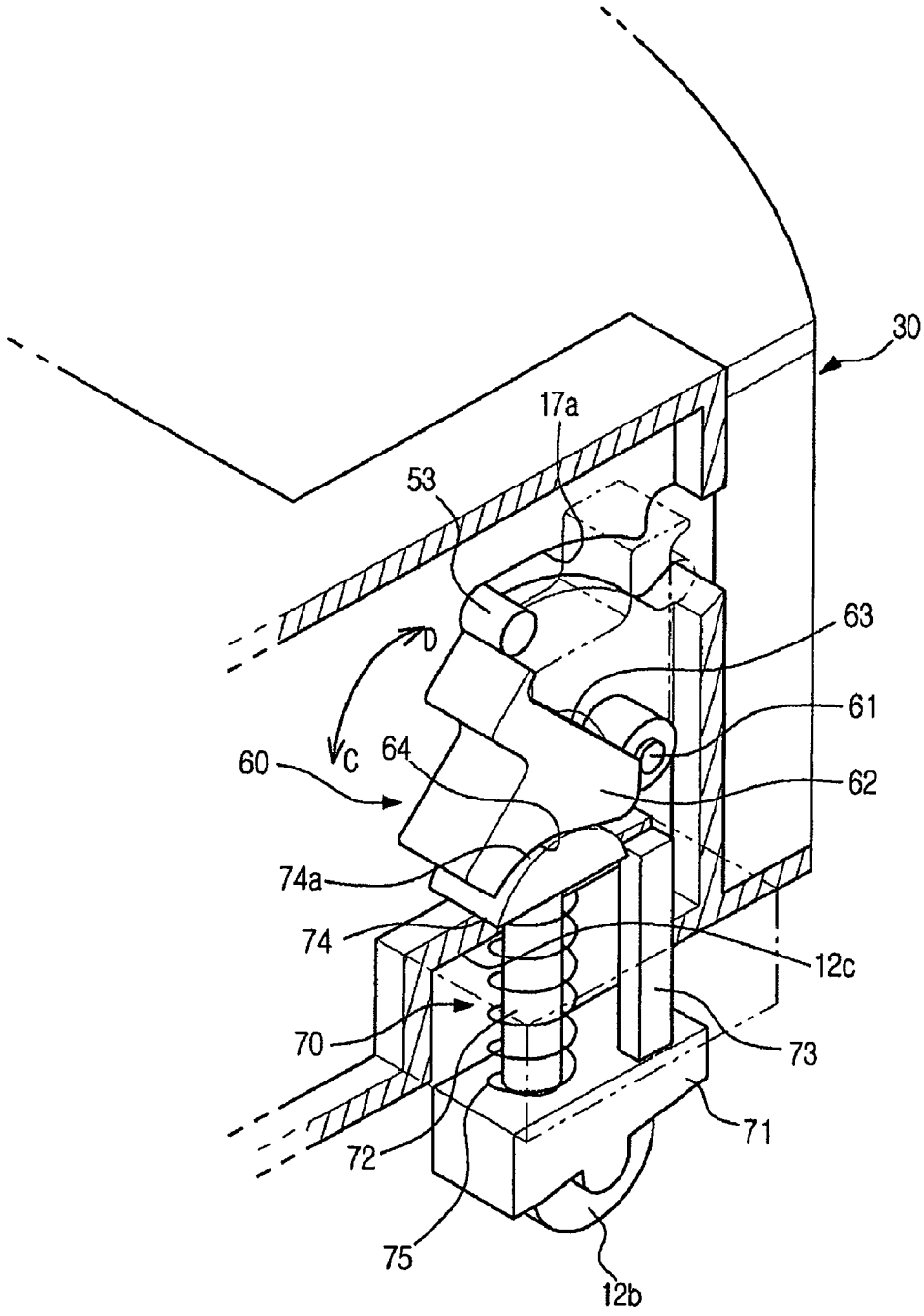
FIGS. 6 and 7 are perspective views, in part, illustrating the operation of the backward-flow preventing device when the robot cleaner according to the embodiment of the present invention is lifted.
Figure 7:
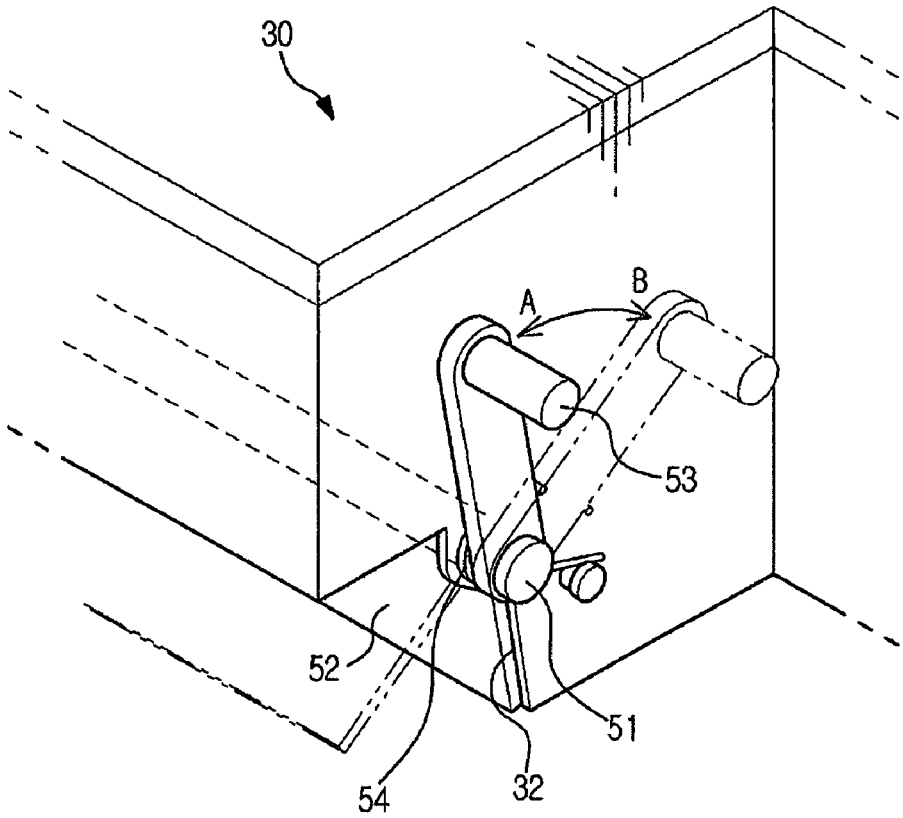

Also, when a situation in which dust may be discharged outside occurs, for example when a user lifts the cleaner body 10 or the cleaner body is lifted by a sudden rise, while the dust tank 30 is coupled to the cleaner body 10, as shown in FIG. 6, the load applied to the rear auxiliary wheel unit 70 decreases, with the result that the spring 75 of the rear auxiliary wheel unit 70 extends, and the rear auxiliary wheel 12*b* moves downward.

At the same time, the stopper support part 64, which is formed at the top of the first guide rod 72 to restrict the hinged rotation of the stopper member 62, moves downward, with the result that the stopper member 62 hingedly rotates in the direction indicated by the arrow C of FIG. 6.

Consequently, the pressure applied to the lever 53, which is being pushed by the stopper member 62, is released. As a result, the lever 53 is hingedly rotated in the direction indicated by the arrow A of FIG. 7 by the restoring force of the elastic member 54, and therefore, the opening and closing plate 52 closes the suction port 32.

Consequently, when a user lifts the cleaner body 10 or the cleaner body 10 is lifted by a sudden rise or the like, the opening and closing plate 52 closes the suction port 32, and therefore, dust in the collection part 31 is prevented from flowing backward outside through the suction port 32.

Also, when the cleaner is placed on the floor, with the result that an increased load is applied to the rear auxiliary wheel 12*b*, as shown in FIG. 4, the rear auxiliary wheel 12*b* moves upward, such that the spring of the rear auxiliary wheel unit 70 is contracted, and, at the same time, the stopper support part 74 moves upward.

Figure 5:
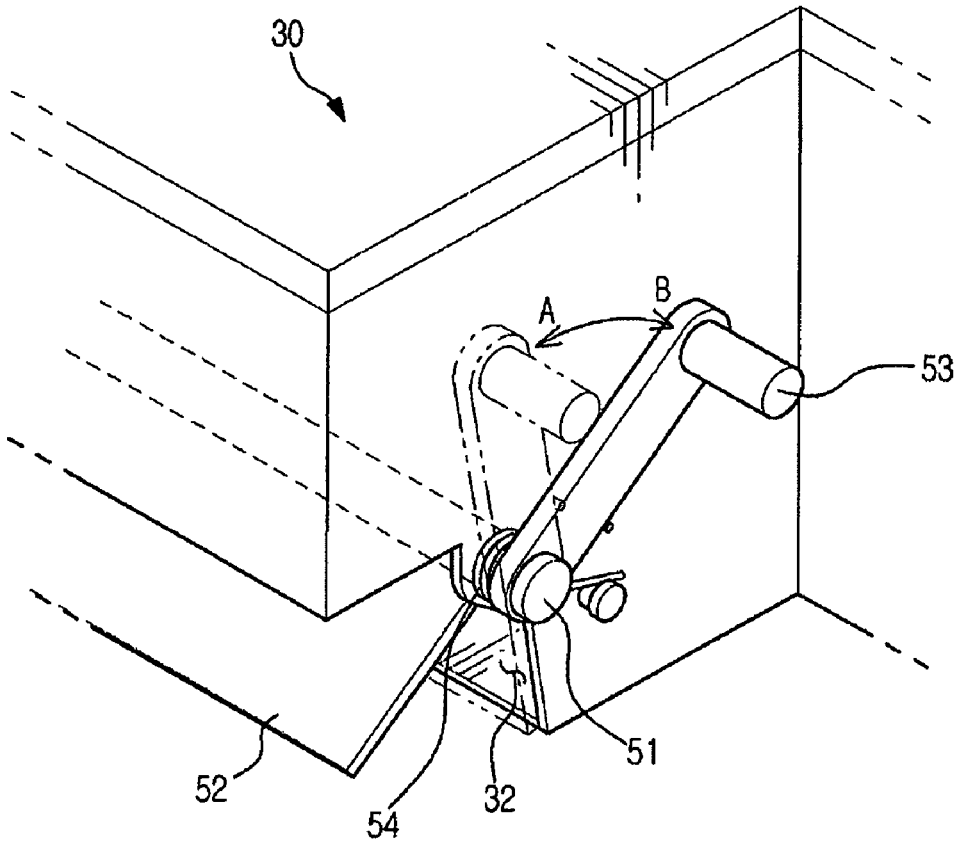

Consequently, the stopper support part 75 pushes the stopper member 62 in the direction indicated by an arrow D, with the result that the stopper member 62 hingedly rotates the lever 53 in the direction indicated by the arrow B of FIG. 5 such that the opening and closing plate 52 opens the suction port 32.

As is apparent from the above description, the robot cleaner according to the present invention includes the backward-flow preventing device. Consequently, the present invention has the effect of preventing dust collected in the dust tank from being discharged outside when a situation in which the dust may be discharged outside occurs.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A robot cleaner comprising:

a cleaner body;

a dust tank separably engaged with the cleaner body in a horizontal direction to collect dust; and a backward-flow preventing device to prevent dust from flowing backward outside through a suction port provided at a lower portion of a side surface of the dust tank, wherein the backward-flow preventing device includes a shutter unit mounted at the side surface of the dust tank to open and close the suction port and a stopper unit mounted at a side surface of the cleaner body corresponding to the installation place of the shutter unit to drive the shutter unit, wherein the shutter unit includes an opening and closing plate hingedly mounted at the suction port side, a pivotable lever to hingedly rotate the opening and closing plate, and wherein the stopper unit is movable between first and second positions, and the stopper unit pushes the lever, such that the lever is hingedly rotated, to open the opening and closing plate in the first position, and the stopper unit releases the pushed state of the lever to close the opening and closing plate in the second position.

2. The robot cleaner according to claim 1, wherein the shutter unit further includes an elastic member to provide an elastic force necessary to maintain the closed state of the suction port achieved by the opening and closing plate.

3. The robot cleaner according to claim 1, wherein the stopper unit is movable between first and second positions, and the dust tank is separably coupled to the cleaner body, and the shutter unit opens the suction port when the dust tank is coupled to the cleaner body and the stopper unit is in the first position, and closes the suction port when the dust tank is separated from the cleaner body and the stopper unit is in the second position.

4. The robot cleaner according to claim 1, wherein the backward-flow preventing device further includes a stopper support part to allow the hinged rotation of the stopper unit when the stopper support part moves vertically downward, or restrict the hinged rotation of the stopper unit when the stopper support part moves vertically upward.

5. The robot cleaner according to claim 4, wherein the cleaner body includes an auxiliary wheel unit, the stopper support part is constructed to move vertically according to a load applied to the auxiliary wheel unit, and the shutter unit opens the suction port when the stopper support part moves vertically upward, and closes the suction port when the stopper support part moves downward.

6. The robot cleaner according to claim 1, wherein the shutter unit opens the suction port when the cleaner body is placed on a floor and closes the suction port when the cleaner body is lifted upward, along with the vertical movement of the cleaner body.

7. The robot cleaner according to claim 1, wherein the backward-flow preventing device further includes a stopper support part to support a predetermined position of the stopper unit such that the stopper unit hingedly rotates the shutter unit to open the suction port when the cleaner body moves upward, or release the supported state of the stopper unit such that the stopper unit hingedly rotates the shutter unit to close the suction port when the cleaner body moves downward.

8. A robot cleaner comprising:

a cleaner body;

a dust tank separably engaged with the cleaner body in a horizontal direction to collect dust; and a backward-flow preventing device to prevent dust from flowing backward outside through a suction port provided at a lower portion of a side surface of the dust tank, wherein the backward-flow preventing device includes a shutter unit mounted at the side surface of the dust tank to open and close the suction port, a stopper unit mounted at a side surface of the cleaner body corresponding to the installation place of the shutter unit to drive the shutter unit, and a stopper support part to allow the hinged rotation of the stopper unit when the stopper support part moves vertically downward, or restrict the hinged rotation of the stopper unit when the stopper support part moves vertically upward, wherein the cleaner body includes an auxiliary wheel unit, the stopper support part is constructed to move vertically according to a load applied to the auxiliary wheel unit, and the shutter unit opens the suction port when the stopper support part moves vertically upward, and closes the suction port when the stopper support part moves downward, and wherein the auxiliary wheel unit includes an auxiliary wheel, a guide rod to guide the vertical movement of the auxiliary wheel, and a spring fitted on the guide rod to elastically support the auxiliary wheel, and the stopper support part is provided at the guide rod.

* * * * *